US006357676B1

(12) United States Patent
Hanft

(10) Patent No.: US 6,357,676 B1
(45) Date of Patent: Mar. 19, 2002

(54) FUEL INJECTION VALVE

(75) Inventor: Werner Hanft, Hallstadt (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/601,493

(22) PCT Filed: Nov. 19, 1999

(86) PCT No.: PCT/DE99/03689

§ 371 Date: Nov. 15, 2000

§ 102(e) Date: Nov. 15, 2000

(87) PCT Pub. No.: WO00/32926

PCT Pub. Date: Jun. 8, 2000

(30) Foreign Application Priority Data

Dec. 2, 1998 (DE) ..... 198 55 568

(51) Int. Cl.[7] ..... B05B 1/30; F02M 51/00

(52) U.S. Cl. ..... 239/585.1; 239/585.4; 239/585.5

(58) Field of Search ..... 239/585.1, 585.2, 239/585.3, 585.4, 585.5, 587.4, 900; 251/356; 137/625.3; 29/890.132, 899.1

(56) References Cited

U.S. PATENT DOCUMENTS 4,103,868 A * 8/1978 Thompson ..... 251/283
4,483,485 A 11/1984 Kamiya et al.
4,705,306 A * 11/1987 Guido et al. ..... 29/525
4,967,966 A 11/1990 Babitzka et al.
5,190,221 A 3/1993 Reiter
5,199,648 A 4/1993 Fujikawa
5,335,864 A * 8/1994 Romann et al. ..... 239/585.1
5,395,050 A * 3/1995 Nowak et al. ..... 239/585.4
5,540,387 A * 7/1996 Reiter et al. ..... 239/585.1
5,570,843 A * 11/1996 Heyse et al. ..... 239/585.1

FOREIGN PATENT DOCUMENTS

DE 38 31 196 A1 3/1990
DE 44 08 875 A1 9/1995
DE 197 12 590 A 10/1998

* cited by examiner

*Primary Examiner*—David A. Scherbel
*Assistant Examiner*—David Hwu
(74) *Attorney, Agent, or Firm*—Kenyon & Kenyon

(57) ABSTRACT

The invention relates to a fuel injection valve having an axially movable valve needle (13) having at least one closing body support (17) and a spherical valve closing body (18). The closing body support (17) accommodates the valve closing body (18) in a downstream end area (46). The valve closing body (18) has at least one flattened zone (24) on its surface, whereby the flattened area has an axial extension component, and whereby at least one channel (47) for a flow of fuel is formed between the at least one flattened zone (24) and an inner wall of the closing body support (17).

The fuel injection valve is especially well suited for use in fuel injection systems of mixture-compressing, SI internal combustion engines.

10 Claims, 2 Drawing Sheets

FUEL INJECTION VALVE

FIELD OF THE INVENTION

The present invention relates to a fuel injection valve.

BACKGROUND OF THE INVENTION

A fuel injection valve in the form of an electromagnetically actuated valve is described, for example in German Patent Application No. 38 31 196, in which a valve needle is formed from an armature, a tubular connecting piece and a spherical valve closing body. The armature and the valve closing body are connected by the connecting piece, the connecting piece serving as a direct closing body support to which the valve closing body is solidly attached by a welded joint. The connecting piece has a multiplicity of flow openings through which the fuel can exit from an interior passageway and flow outside of the connecting piece to the valve closing body or to a valve seat face cooperating with the valve closing body. In addition the roll-bent connecting tube has a longitudinal slot running its entire length, the hydraulic flow cross-section section of which is large so that fuel coming from the interior passageway can flow through it quickly. Most of the fuel to be injected already flows out of the connecting piece over its length, while a small remnant portion does not exit from the connecting piece until immediately at the sphere surface.

German Patent Application No. 197 12 590 is an electromagnetically actuated valve that has an axially movable valve needle composed of an armature, which is either itself a closing body support or is connected to a closing body support, and a spherical valve closing body. The closing body support here accommodates the valve closing body in a downstream end area of the valve closing body. To do this, the end area encompasses the valve closing body so that at least one channel directly connected with a longitudinal bore of the closing body support is formed on the surface of the valve closing body. The end area extends here beyond the equator of the valve closing body. A solid connection is achieved by edge-forming or press-fitting.

Shaping out diagonally running grooves or flattened zones on the surface of spherical valve closing bodies of fuel injection valves is already described, for example in U.S. Pat. No. 5,199,648 and German Patent Application No. 44 08 875, the grooves or flattened zones being used exclusively for angled impingement of the fuel to be injected. The flow toward these formed closing body geometries occurs in this case from outside a tubular connecting piece of the valve needle and not against the spherical surface starting from an inner opening of the connecting piece, which functions as a closing body support.

A fuel injection valve that has a valve needle with a spherical valve closing body can be inferred from U.S. Pat. No. 4,483,485. The spherical valve closing body can also be provided with a horizontal flattened zone that extends inside the connecting piece of the valve needle being used as the closing body support. In order to enable a flow of fuel from an inner opening of the connecting piece to the valve seat, either transverse openings or several slotted openings that open toward the valve closing body are provided in the wall of the connecting piece. For all embodiments of the valve needle described in this specification, an opening geometry specially built into the closing body support and requiring additional manufacturing or machining steps is needed for the outflow of the fuel.

SUMMARY

The fuel injection valve according to the present invention has the advantage that it can be produced in an especially simple and economical manner. For this purpose a spherical valve closing body is provided with at least one flattened zone having an axial extension component and is solidly connected with a sleeve-shaped closing body support. The closing body support can be fabricated to be rotationally symmetric for this in a very simple way, without the necessity of incorporating any kinds of opening geometry for the outlet of fuel on its exterior contour. Thus all machining steps that are typically needed for such additional flow openings are omitted. The end area of the closing body support encompasses the valve closing body in such a way that it forms one or more channels—corresponding to the number of flattened zones—directly on the surface of the valve closing body through which fuel can flow unhindered from the interior longitudinal bore coming toward a valve seat face. In this way an optimal flow to the metering area of the valve is achieved with little manufacturing effort.

Additional advantageous embodiments and improvements of the fuel injection valve are possible.

It is advantageous to form the at least one flattened zone at an angle to the valve longitudinal axis of between 12 and 25° and to have the flattened zone run beyond a spherical equator of the valve closing body in the downstream direction.

In a especially advantageous way an magent armature can itself be used directly as the closing body support so that together with the valve closing body a two part valve needle is formed. A valve needle of this type can be produced especially simply and economically, and due to the reduced number of parts has only a single connecting piece.

DETAILED DESCRIPTION

Figure 1:
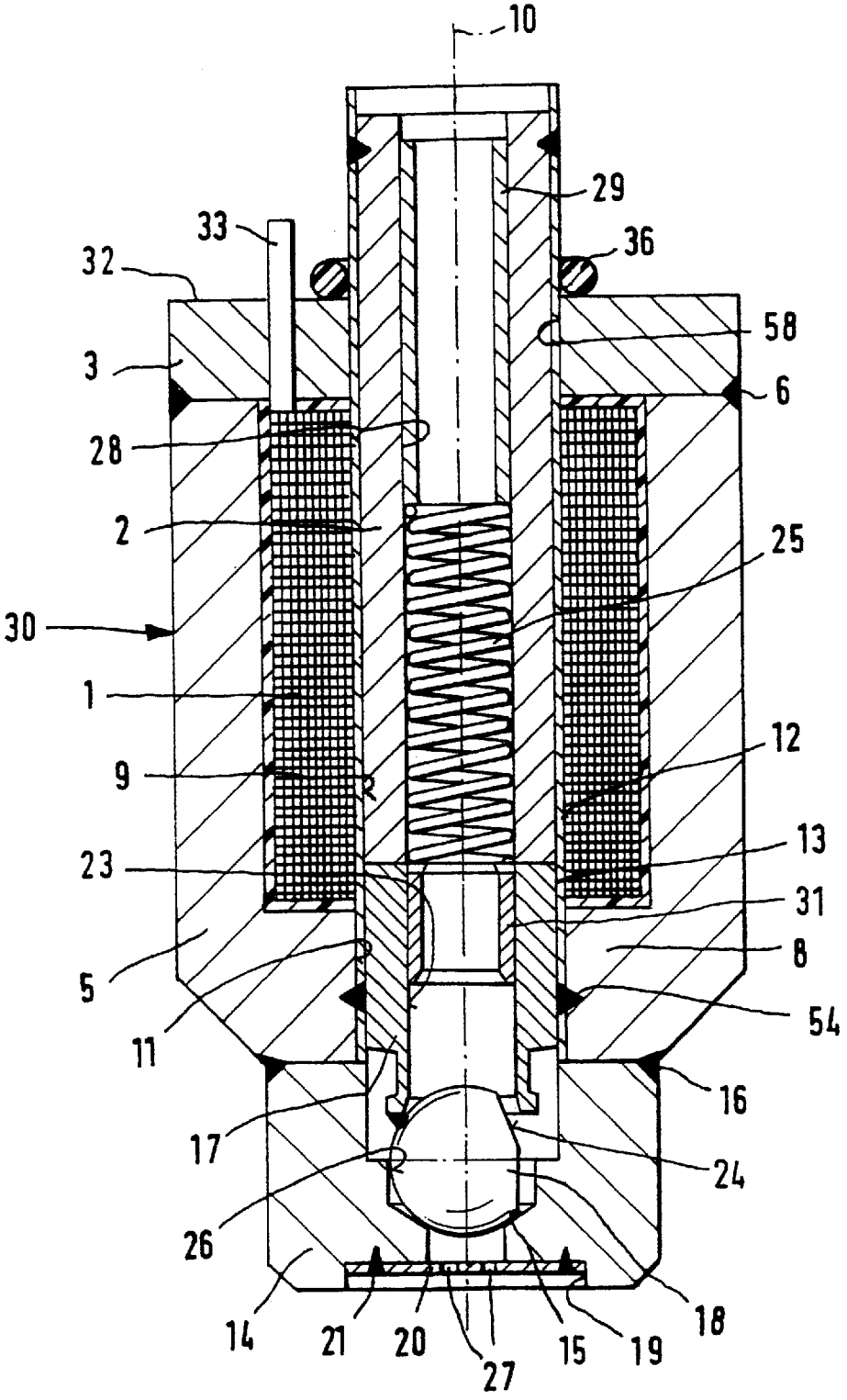
FIG. 1 is a sectional view of a fuel injection valve according to the present invention.

The fuel injection valve according to the present invention, which is depicted in part in simplified representation for purposes of example in FIG. 1 and is in the form of an injection valve for fuel injection systems of mixture-compressing SI internal combustion engines, has an essentially tubular core 2 that is encompassed by a magnet coil 1 and serves as an inner pole and in part as a fuel passageway. Together with an upper, disk-shaped covering element 3, the core 2 enables an especially compact design of the injection valve in the area of the magnet coil 1. The magnet coil 1 is encompassed by an outer ferro-magnetic valve casing 5 as an outer pole that completely encompasses the magnet coil 1 in the circumferential direction and at its top end is solidly connected with the covering element 3, e.g. by a welded joint 6. To close the magnetic circuit, the valve casing 5 has a staggered design at its lower end so that a guide section 8 is formed which, in similar fashion as the covering element 3, axially encompasses the magnet coil 1 and which represents the border of the magnet coil area 1 below or in the downstream direction.

The guide section 8 of the valve casing 5, the magnet coil 1 and the covering element 3 form an inner opening 11 or 58 running concentrically with respect to a valve longitudinal axis 10. A longitudinally extended sleeve 12 extends in the opening 11 or 58. An inner longitudinal opening 9 of the ferritic sleeve 12 serves in part as the guide opening for a valve needle 13 that is axially movable along the valve longitudinal axis 10. When viewed in the downstream direction, sleeve 12 terminates for example in the area of the guide section 8 of the valve casing 5, the sleeve 12 being solidly attached to the valve casing by a welded joint 54, for example.

Figure 6:
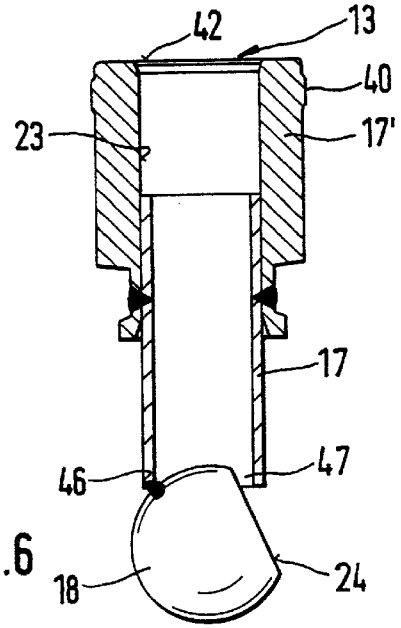
FIG. 6 is a sectional view of third exemplary embodiment of a valve needle.

In the exemplary embodiment represented in FIG. 1, the valve needle 13 is formed by a tubular closing body support 17, which also functions as an armature and an essentially spherical valve closing body 18. As shown in FIG. 6, the valve needle 13 can also be formed from three pieces by an armature 17', a closing body support 17 and a valve closing body 18. In addition to the axially movable valve needle 13, the stationary core 2 is also arranged in the longitudinal opening 9 of the sleeve 12. Along with the guide of the closing body support 17 or the receptacle of the core 2, the sleeve 12 also fulfills a sealing function so that there is a dry magnet coil 1 in the injection valve. This is also achieved by virtue of the disk-shaped covering element 3 completely covering the magnet coil 1 on its top side. The inner opening 58 in the covering element 3 enables the sleeve 12, and thus also the core 2, to be configured as elongated so that both components protrude through the opening 58 above the covering element 3.

A valve seat body 14 that has a fixed valve seat face 15 as a valve seat is connected on the lower guide section 8 of the valve casing 5. The valve seat body 14 is solidly attached to the valve casing 5 by a second welded joint 16 produced by a laser, for example. A flat perforated injection disk 20 is arranged on the downstream face of the valve seat body 14, for example in a recess 19, the fixed connection of valve seat body 14 and perforated injection disk 20 being realized by a circumferentially sealed welded joint 21. The tubular closing body support is solidly attached on its downstream end facing the perforated injection disk 20 with the spherical valve closing body 18, for example by welding. Closing body support 17 has an inner longitudinal bore 23 through which fuel flows and out of which it exits downstream and can flow along, in the area of at least one flattened zone 24 that is directly on valve closing body 18 and has an axial extension component, until it reaches valve seat face 15.

The actuation of the injection valve is accomplished in a conventional manner e,g., electromagnetically. However, it must be emphasized that a piezoelectric actuator can also be used for the actuation of the valve needle 13. The electromagnetic circuit with the magnet coil 1, the inner core 2, the outer valve casing 5 and the armature 17 are all used to produce the axial motion of the valve needle 13, that is to open the injection valve against the spring force of a return spring 25 or to close the valve. The closing body support 17 functioning as an armature is aligned with the end on the core 2 opposite the valve closing body 18.

Spherical valve closing body 18 cooperates with conical valve seat face 15, which narrows in the direction of flow and which is made in valve seat body 14 axially downstream from a guide opening 26. The perforated injection disk 20 has at least one injection opening, or for example four injection openings 27, formed by eroding or stamping.

An adjustment sleeve 29 outside of the return spring 25 is inserted into a flow hole 28 of the core 2 running concentrically with respect to the valve longitudinal axis 10, the flow hole being used to feed the fuel in the direction of the valve seat face 15. The adjustment sleeve 29 is used for the adjustment of the preliminary spring tension of the return spring 25 adjacent to the adjustment sleeve 29, the return spring in turn pushing with its opposite side against an insert 31 solidly attached to the closing body support 17, a setting of the dynamic injection quantity being made with the adjustment sleeve 29.

Such an injection valve is distinguished by its especially compact design, so that a very small, manageable injection valve is produced. The valve casing 5 has for example an outer diameter of only 11 mm. The previously described components form a preassembled independent assembly that can be characterized as a functional part 30. The pre-adjusted and pre-assembled functional part 30 has for example a top face 32 above which for instance two connector pins 33 protrude. The electrical contacting of the magnet coil 1 and thus its excitation are accomplished by the electrical contact pins 33, which are used as electrical connecting elements.

A connecting part (not shown), which is primarily distinguished in that it includes the electrical and hydraulic connection of the injection valve, can be attached to such a functional part 30. A hydraulic connection of the connecting part (not shown) and the functional part 30 is accomplished in the fully mounted injection valve by flow holes of both assemblies being situated in relation to one another such that an unhindered circulation of the fuel is guaranteed. Here the face 32 of the functional part 30 for example is then directly adjacent to a lower face of the connecting part and is solidly attached to it. In the assembly of the connecting part on the functional part 30, the part of the core 2 and the sleeve 12 extending above the face 32 can protrude into a flow hole of the connecting part to increase the connection stability. For secure sealing, the connecting area has, for example, a sealing ring 36 that encompasses the sleeve 12 bearing on the face 32 of the covering element 3. In the completely assembled valve, the contact pins 33 serving as electrical connecting elements make a secure electrical connection with the corresponding electrical connecting elements of the connecting part.

Figure 2:
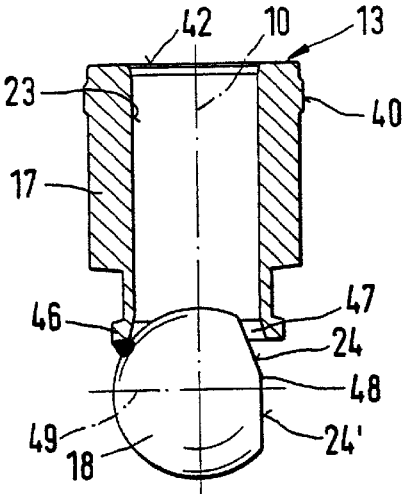
FIG. 2 is a sectional view of a first exemplary embodiment of a valve needle.

FIG. 2 shows a valve needle 13 in an enlarged scale compared to FIG. 1. The tubular closing body support 17 is designed as a rotary component having a multiple staggered outer contour. An annular guide surface 40, for example, that is used to guide the axially movable valve needle 13 into the sleeve 12 is formed on the outer perimeter of the closing body support 17. The closing body support 17 fabricated for example from a ferritic material (chromium steel) has an upper stopping face 42 opposite the core 2 that is provided with a wear-resistant coating, i.e. is chromed.

The inner longitudinal bore 23 in the closing body support 17 has an essentially circular cross-section. Overall, the closing body support 17 is designed as rotationally symmetric in an advantageous way. The essentially spherical valve closing body 18 has on its outer perimeter at least one flattened zone 24 with an axial extension component. In a downstream end area 46, the closing body support 17 surrounds the valve closing body 18, which also protrudes partially into the longitudinal bore 23 of the closing body support 17. In the area in which the closing body support 17 stands upright on the valve closing body 18, a fixed attachment is provided, for example by welding. The at least one flattened zone 24 is formed on the valve closing body 18 such that it protrudes into the longitudinal bore 23. This ensures that there is at least one channel 47 between the inner wall of the closing body support 17 and the flattened zone 24 through which the fuel supplied in the longitudinal bore 23 and flowing along the valve closing body 18 is routed in the direction of the valve seat face 15.

Figure 3:
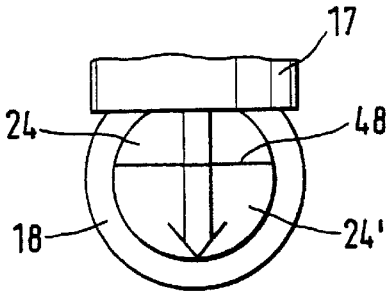
FIG. 3 is a schematic view illustrating a fuel flow against the valve needle shown in FIG. 2.

The angle of the flattened zone 24 to the valve longitudinal axis 10 is, for example, between 12° and 25°. However, other angles between 10° and 50° are also conceivable. An additional flattened zone 24' that is for example vertical and thus parallel to the valve longitudinal axis 10 can also adjoin the diagonally inclined flattened zone 24. In this case a transitional edge 48 from the first flattened zone 24 to the second flattened zone 24' lies further upstream from a sphere equator 49 of the valve closing body 18. The flattened zone 24' clearly extends past the sphere equator 49 in the downstream direction so that an essentially central flow of fuel along the valve closing body 18 is produced, as is symbolically indicated by an arrow in FIG. 3.

Figure 4:
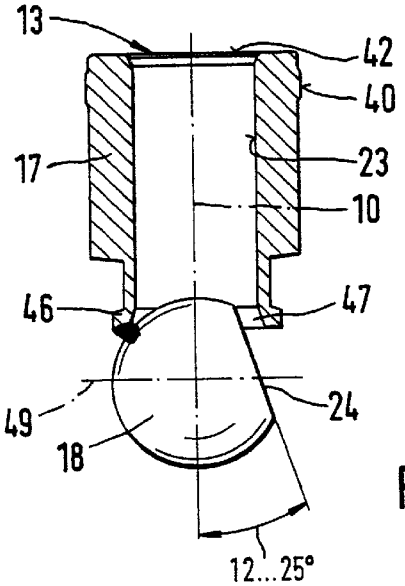
FIG. 4 is a sectional view of a second exemplary embodiment of a valve needle.
Figure 5:
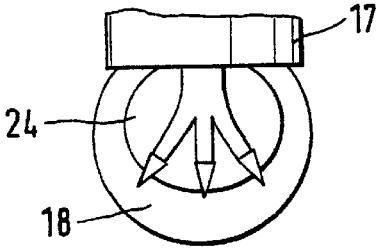
FIG. 5 is a schematic view illustrating a fuel flow against the valve needle show in FIG. 4.

FIG. 4 shows a second exemplary embodiment of a valve needle 13 in which the parts that are the same or function the same as the sample embodiment represented in FIG. 2 are designated by the same reference numbers. The valve needle 13 shown in FIG. 4 is distinguished in that the flattened zone 24 is not segmented and steadily runs at a constant angle of between 12° and 25° to the valve longitudinal axis 10 beyond the sphere equator 49. Symbolically shown in FIG. 5 by several arrows is that such an embodiment makes it possible for the flow of fuel to fan out more, which can be advantageous for a more broadly spread flow against the valve seat face 15.

FIG. 6 shows an additional exemplary embodiment of a valve needle 13. In this sample embodiment of the valve needle 13, the armature 17' and the valve closing body 18 are connected to each other by a sleeve-shaped connecting part, the connecting part then forming the closing body support 17. The connections to the valve needle 13 are produced here for example by welding. The functions and geometric ratios already described previously for the closing body support 17 functioning as an armature are equally valid for the closing body support 17 representing a connecting part in FIG. 6. The valve closing body 18 corresponds for example to that of the sample embodiment shown in FIG. 4. In principle more than one flattened zone 24 can be provided.

In addition to making the closing body support 17 as a turned part or cold-pressed part, embodiments are also conceivable in which it is a sintered part or MIM (metal injection molding) part.

What is claimed is:

1. A fuel injection valve having a valve longitudinal axis, the fuel injection valve comprising:

a fixed valve seat;

a valve needle movable along the valve longitudinal axis, the valve needle including at least one closing body support and a substantially spherical valve closing body, the valve closing body being solidly attached to them closing body support, the valve closing body cooperating with the fixed valve seat, the closing body support including an inner longitudinal bore extending up to a surface of the valve closing body; and an actuator for actuating the valve needle;

wherein the valve closing body includes at least one flattened zone having an axial extension component on a surface thereof and wherein at least one channel for a flow of fuel is formed between the at least one flattened zone and an inner wall of the closing body support.

2. The fuel injection valve according to claim 1, wherein the at least one flattened zone is arranged at a diagonally inclined angle relative to the valve longitudinal axis.

3. The fuel injection valve according to claim 2, wherein the angle is between 12° and 25°.

4. The fuel injection valve according to claim 1, wherein the flattened zone is formed of several sections, one flattened zone arranged at a diagonally inclined angle relative to the valve longitudinal axis and another one flattened zone arranged parallel to the valve longitudinal axis.

5. The fuel injection valve according to claim 4, wherein the valve closing body includes a sphere equator and wherein a transitional edge is arranged between two flattened sections upstream of the plane of the sphere equator.

6. The fuel injection valve according to claim 1, wherein at least one flattened zone extends in a downstream direction beyond a sphere equator of the valve closing body.

7. The fuel injection valve according to claim 1, wherein the closing body support is configured as a magnet armature.

8. The fuel injection valve according to claim 1, wherein the closing body support includes a connecting part connecting an armature and the valve closing body.

9. A fuel injection valve having a valve longitudinal axis and including a fixed valve seat, a valve needle movable along the valve longitudinal axis, the valve needle further including at least one closing body support and a substantially spherical valve closing body, the valve closing body being solidly attached to the closing body support, the valve closing body cooperating with the fixed valve seat and including at least one flattened zone having an axial extension component on a surface thereof, the closing body support further including an inner longitudinal bore extending up to a surface of the valve closing body, and an actuator for actuating the valve needle, the fuel injection valve being made according to a turning or cold-pressing process.

10. A fuel injection valve having a valve longitudinal axis, the fuel injection valve comprising:

a fixed valve seat;

a valve needle movable along the valve longitudinal axis, the valve needle including at least one closing body support and a substantially spherical valve closing body, the valve closing body being solidly attached to the closing body support, the valve closing body cooperating with the fixed valve seat, the closing body support including an inner longitudinal bore extending up to a surface of the valve closing body; and wherein the valve closing body includes at least one flattened zone having an axial extension component on a surface thereof and wherein at least one channel for a flow of fuel is formed between the at least one flattened zone and an inner wall of the closing body support, the at least one flattened zone being formed of more than one section, each section at a different angle with respect to the valve longitudinal axis.

* * * * *